US010674801B2

(12) United States Patent
Noguera Ramis

(10) Patent No.: US 10,674,801 B2
(45) Date of Patent: Jun. 9, 2020

(54) INTERACTIVE BACKPACK

(71) Applicant: TOYBAGS, S.L.U., Ondara (ES)

(72) Inventor: Antonio Noguera Ramis, Ondara (ES)

(73) Assignee: TOYBAGS, S.L.U., Ondara (ES)

( * ) Notice: Subject to any disclaimer, the term of this patent is extended or adjusted under 35 U.S.C. 154(b) by 0 days.

(21) Appl. No.: 16/314,701

(22) PCT Filed: Mar. 31, 2017

(86) PCT No.: PCT/ES2017/070190
§ 371 (c)(1),
(2) Date: Jan. 2, 2019

(87) PCT Pub. No.: WO2018/002391
PCT Pub. Date: Jan. 4, 2018

(65) Prior Publication Data

US 2019/0239613 A1 Aug. 8, 2019

(30) Foreign Application Priority Data

Jul. 1, 2016 (ES) ..... 201630867 U

(51) Int. Cl.
*A45F 3/04* (2006.01)
*A45C 15/06* (2006.01)
(Continued)

(52) U.S. Cl.
CPC ..... *A45C 15/06* (2013.01); *A45F 3/04* (2013.01); *A63H 3/28* (2013.01); *A45F 3/042* (2013.01); *A45F 2003/003* (2013.01)

(58) Field of Classification Search
CPC ..... A45F 3/04; A45F 3/042; A45F 2003/001; A45F 2003/003; A63H 3/006; A63H 3/28; A45C 15/06
See application file for complete search history.

(56) References Cited

U.S. PATENT DOCUMENTS 3,162,977 A * 12/1964 Elischer ..... A63H 13/005 446/303
5,255,834 A * 10/1993 Bendersky ..... A45C 13/08 206/457
(Continued)

FOREIGN PATENT DOCUMENTS

DE 4101595 A1 * 7/1992 ..... A45C 15/06
DE 9415106 U1 * 1/1996 ..... A45C 15/06
(Continued)

OTHER PUBLICATIONS

Dora Surprise Eggs from Dora the Explorer Talking Backpack. Youtube.com, <URL: https://youtu.be/Xv0PqkCB3UQ>.

*Primary Examiner* — Justin M Larson
(74) *Attorney, Agent, or Firm* — Hoglund & Pamias, PSC; Roberto J. Rios

(57) ABSTRACT

The invention relates to an interactive backpack comprising a backpack body, wherein the backpack body comprises the form of a character, as well as comprising: lighting means linked to the form of the character, sound means, control means linked to the lighting means and sound means, wherein the control means are configured for the synchronized and coordinated activation of the lighting and sound means; wherein the backpack further comprises an actuator for the control means, with the actuator being disposed in an attachment which is joined to the backpack body.

10 Claims, 3 Drawing Sheets

(51) Int. Cl.
*A63H 3/28* (2006.01)
*A45F 3/00* (2006.01)

(56) References Cited

U.S. PATENT DOCUMENTS 5,791,965 A 8/1998 Kim
5,836,671 A * 11/1998 Chien ..... A45C 15/06 362/84
5,897,042 A * 4/1999 Sims ..... A45C 15/00 206/457
D425,697 S * 5/2000 Chapman ..... D3/216
6,121,877 A * 9/2000 Johnson ..... A45C 13/24 340/568.7
D433,800 S * 11/2000 Chapman ..... D3/216
D438,700 S * 3/2001 Willingham ..... A45F 3/04 D3/216
D448,922 S * 10/2001 Willingham ..... A45F 3/04 D3/216
D448,923 S * 10/2001 Willingham ..... A45F 3/04 D3/216
D450,447 S * 11/2001 Willingham ..... A45F 3/04 D3/216
6,343,968 B1 * 2/2002 Louie ..... A45F 4/08 2/69.5
6,421,852 B1 * 7/2002 Shao ..... A63H 3/005 446/73
6,488,190 B1 * 12/2002 Alonzo ..... A45F 3/04 224/576
6,510,974 B2 * 1/2003 Willingham ..... A45C 7/0095 190/16
6,739,933 B2 * 5/2004 Taylor ..... A45F 5/00 220/703
6,769,585 B2 * 8/2004 Santaniello ..... A45C 13/08 190/109
6,802,757 B1 * 10/2004 Sejnowski ..... A63H 33/006 446/175
7,270,438 B2 * 9/2007 Chen ..... A45C 15/06 362/108
D577,491 S * 9/2008 Rapisarda ..... D3/321
7,677,894 B2 * 3/2010 Duprey ..... G09B 25/06 434/131
D614,398 S * 4/2010 Gold ..... D3/216
D614,399 S * 4/2010 Gold ..... D3/216
D614,863 S * 5/2010 Gold ..... D3/216
D617,089 S * 6/2010 Gold ..... D3/216
D617,090 S * 6/2010 Gold ..... D3/216
D617,091 S * 6/2010 Gold ..... D3/216
D617,092 S * 6/2010 Gold ..... D3/216
D617,548 S * 6/2010 Gold ..... D3/216
D620,702 S * 8/2010 Gold ..... D3/216
D623,238 S * 9/2010 Gold ..... D3/216
D624,748 S * 10/2010 Gold ..... D3/216
7,892,064 B2 * 2/2011 Carruth ..... A63H 33/00 190/109
D670,904 S * 11/2012 Gerchen ..... D3/217
D685,989 S * 7/2013 Fitl ..... D3/216
8,496,344 B1 * 7/2013 Chapman ..... A45C 15/06 362/108
D711,091 S * 8/2014 Mooney ..... D21/603
8,926,392 B2 * 1/2015 Strong ..... B65D 25/28 446/197
8,926,394 B1 * 1/2015 Strong ..... A63H 3/48 224/153
D722,234 S * 2/2015 BenDavid ..... D3/223
D734,024 S * 7/2015 Garcia ..... D3/216
9,226,565 B1 * 1/2016 Martin ..... A45F 4/06
9,327,863 B1 * 5/2016 Baselice ..... B65D 5/425
9,474,355 B1 * 10/2016 Chadwick ..... A45F 3/042
9,573,073 B1 * 2/2017 Mazur ..... A63H 33/004
D803,550 S * 11/2017 Shaholli ..... D3/216
D803,551 S * 11/2017 Shaholli ..... D3/216
D804,167 S * 12/2017 Shaholli ..... D3/216
D809,784 S * 2/2018 Lee ..... D3/217
D809,785 S * 2/2018 Lee ..... D3/217
D811,080 S * 2/2018 Lee ..... D3/217
9,986,813 B2 * 6/2018 Nakamura ..... A45D 8/24
10,338,679 B2 * 7/2019 Weston ..... A41D 11/00
10,405,640 B2 * 9/2019 Coleman ..... A45F 3/042
2004/0076000 A1 4/2004 Thorp
2005/0279794 A1 * 12/2005 Gerchen ..... A45F 3/042 224/576
2006/0213943 A1 * 9/2006 Gold ..... A45F 3/04 224/576
2007/0175939 A1 * 8/2007 Gold ..... A45F 3/04 224/576
2008/0035074 A1 * 2/2008 Diez ..... A45C 13/30 119/770
2008/0173686 A1 * 7/2008 Kennedy ..... A45F 3/042 224/600
2009/0201671 A1 * 8/2009 Huntley ..... A01K 27/006 362/108
2012/0329358 A1 * 12/2012 Cupid ..... A63H 3/003 446/73
2015/0041511 A1 * 2/2015 Powell ..... A45C 13/18 224/576
2016/0051038 A1 * 2/2016 Okulovich ..... A45F 3/04 224/576
2017/0280867 A1 * 10/2017 Peters ..... A47B 23/002
2017/0319973 A1 * 11/2017 Perez ..... A63H 3/003
2019/0022538 A1 * 1/2019 Sutton ..... A63H 3/006
2019/0239613 A1 * 8/2019 Noguera Ramis ..... A45C 15/06
2019/0239625 A1 * 8/2019 Westrick ..... A45F 3/042

FOREIGN PATENT DOCUMENTS

EP 3479731 A1 * 5/2019 ..... A45C 15/06
ES 1081206 6/2013
ES 1135108 12/2014
FR 2853502 A1 * 10/2004 ..... A45C 13/24
FR 2853502 B1 * 7/2005 ..... A45C 13/24
GB 2505212 A * 2/2014
WO WO-2015025115 A1 * 2/2015
WO WO-2018002391 A1 * 1/2018 ..... A45C 15/06
WO WO-2018002392 A1 * 1/2018 ..... A45C 15/06
WO WO-2018033653 A1 * 2/2018 ..... A45F 3/04

* cited by examiner

INTERACTIVE BACKPACK

CROSS-REFERENCE TO RELATED APPLICATIONS

This application claims priority of international application PCT/ES2017/070190, filed on 31 Mar. 2017, which claims priority to Spanish Utility Model application no. 201630867, publication number ES1162033, filed on 1 Jul. 2016.

FIELD OF THE INVENTION

The object of the present invention relates to an interactive backpack of the type used for carrying objects, such as school supplies, sport supplies, food, etc.

The present interactive backpack particularly comprises interactive elements for the learning and entertainment of a child user.

BACKGROUND OF THE INVENTION

The use of children's backpacks to enable child users to carry their objects, for example to school, sports centers, recreational spaces, etc., is known in the state of the art.

These known backpacks usually have a sack or bag configuration with a belt or handle for carrying the same. Furthermore, there may also be images on any of the backpack surfaces.

An interactive backpack having a form that looks like a character which is generally known among children is known from patent document ES1135108. Furthermore, it also comprises sound recording, and reproduction means, such that the user can record his or her voice messages and hear them being played back by a loudspeaker located in the backpack. This backpack further comprises a mechanism located in the mouth of the form to simulate the movement of opening and closing the mouth while playing back the recording.

Patent document ES1081206 discloses a backpack comprising loudspeakers for playing music and light emitting means to notify of the presence of the user on a road. The backpack is made with small dimensions, "similar to a fanny pack", and can be secured to the body of the user or can be hooked to the belts or straps of a "conventional" backpack. However, the backpack of this document "similar to a fanny pack" is not conceived for carrying relatively bulky items such as children's books or notebooks or sports gear; in any case, it can be joined to another conventional backpack which is in fact provided for carrying relatively bulky items. Furthermore, the actuation of the lights and the music is performed independently, without there being any relation between them.

Nevertheless, backpacks for children that are capable of attracting the user so that they can be used for recreational purposes and at the same time have a didactic function, i.e., children can learn, are not known in the examples of the state of the art.

SUMMARY OF THE INVENTION

An object of the invention is an interactive backpack comprising a backpack body, wherein the backpack body comprises at least one form of a character, as well as comprising:

lighting means linked to the form of the character, sound means, control means linked to the lighting means and sound means, wherein the control means are configured for the synchronized and coordinated activation of the lighting and sound means;

the backpack further comprising at least one actuator for the control means, with the actuator being disposed in an attachment which is joined to the backpack body.

As a result of these features, an interactive backpack is obtained which is capable of actuating the lights in a manner which is synchronized and coordinated with the sounds, which attracts the user to using the invention. This allows for the user to enjoy a recreational aspect, as the child can play with the form of the character, with the lights emitted by the lighting means and the sounds emitted by the sound means.

On the other hand, the child user can also acquire certain knowledge from the emitted sounds, for example lists of information such as numbers, names, countries, songs, etc., in different languages. The simultaneous operation of the lighting means and sound means makes it easier for the child user to be attentive while acquiring knowledge. As mentioned, coordinating the operation or activation of both lighting and sound means allows a more powerful attraction of the child user, as it has a more appealing effect, similar to the effect the character may have on television, in the movies, on the Internet, etc.

As a result of being able to dispose the actuator in an attachment joined to the backpack body, greater versatility is achieved since the attachment can be adapted to each case or form of the character and the relative location of the attachment with respect to the backpack body can be modified. It is furthermore easier and simpler for the user to locate and actuate the actuator.

According to an example of the invention, the lighting means can be disposed in correspondence with an eye of the form of the character. According to another example of the invention, the lighting means can be configured assembled in the backpack body such that they illuminate from the inside an eye of the form of the character.

These two examples allow the interactive backpack when in operation to transmit a sensation similar to that of the character when it appears on television, in the movies, on the Internet, etc.

In an additional example of the invention, the lighting means can be disposed in correspondence with the mouth of the form of the character. As a result of this additional example, the sensation of similarity of the present backpack with respect to the character on the television, in the movies, on the Internet, etc., is augmented.

In an example of the present invention, the lighting means can comprise at least one LED.

In an example of the present invention, the attachment can be made of a flexible material, thereby achieving greater comfort for the user and adaptability of the attachment in relation to different operations.

In another example of the invention, the attachment can be an element linked to the form of the character. This element linked to the form of the character can be, by way of example, an ear of said form of the character. This example induces the child user to actuate the mechanism, even repeatedly, whereby said child user can readily acquire knowledge while having fun at the same time.

In another additional example of the invention, the attachment can be a belt for carrying the backpack. As a result of this disposition, the actuation can be performed while the user is carrying the backpack on his or her back.

According to another example of the present interactive backpack, the sound means can comprise a loudspeaker.

According to another example of the invention, the control means can be configured for the synchronized and coordinated activation of the lighting and sound means with predefined operating parameters. It is thus possible to predefine particular parameters for the activation of the sound and light so as to more realistically simulate the character from the television, the movies, the Internet, etc.

Other objects, advantages and features of embodiments of the invention will become evident for a person skilled in the art based on the description, or these can be learned by putting the invention into practice.

BRIEF DESCRIPTION OF THE DRAWINGS

Particular embodiments of the present invention will be described below by way of non-limiting example in reference to the attached drawings, in which.

DETAILED DESCRIPTION OF THE INVENTION

Respective embodiments of the interactive backpack according to the present invention, generally designated with reference number 1, are depicted in the attached figures. Some non-visible elements are depicted with discontinuous lines to help understand the invention.

Figure 1:
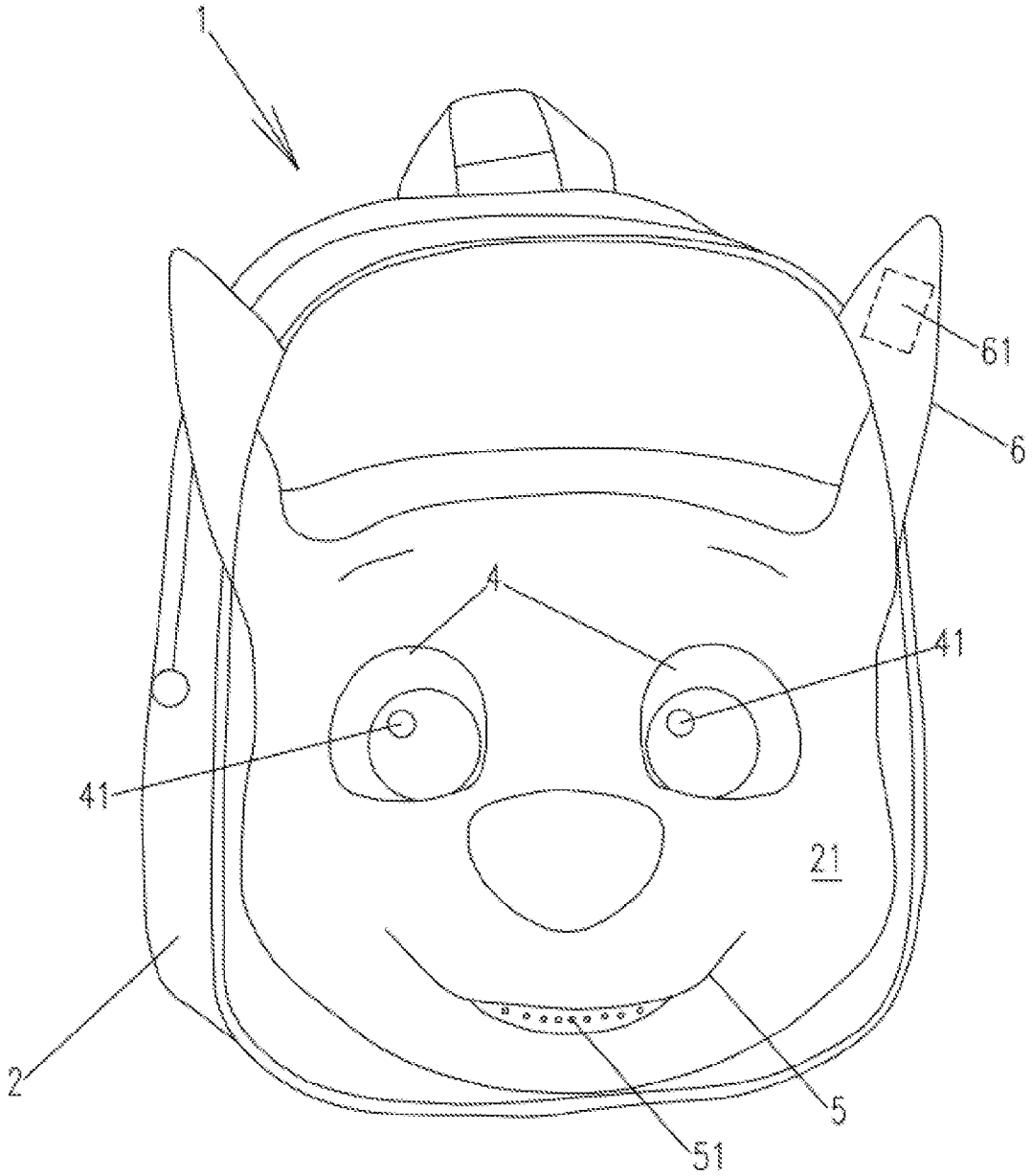
FIG. 1 is a schematic front perspective view of a first embodiment of the present invention.

The interactive backpack 1 can comprise a backpack body 2. The backpack body 2 can in turn comprise at least one form of a character 21, as depicted in FIG. 1.

The interactive backpack 1 can additionally comprise:

- lighting means 41, 51, which can be linked to the backpack body 2 and comprise at least one LED or another type of light emitter;
- sound means 8, which can comprise at least one loudspeaker or another type of sound emitter; and
- control means 7, which can be linked to the lighting means 41, 51 and the sound means 8. The control means 7 can be configured for the synchronized and coordinated activation of the lighting means 41, 51 and the sound means 8. The control means 8 can additionally be configured for storing at least one audio track. This audio track can be of any type, such as, for example, voice, music, sounds, the combination thereof or any other type of audio susceptible to being emitted through the sound means, and the system used for storing the audio can be any system available in the art. In an example of the invention, the control means 7 can comprise an electronic device.

In several examples, the lighting means 41 can be disposed in correspondence with an eye 4 of the form of the character 21, or they can be configured assembled in the backpack body 2 such that they illuminate, from the inside, an eye 4 of the form of the character 21. In both cases, the lighting means 41 can be disposed in correspondence with and/or illuminate the two eyes 4 of the form of the character 21. The eye 4 can be illuminated from the inside as a result of being able to comprise a LED (or other lighting means) which illuminates from the inside the outermost surface of the eye 4.

In another example of interactive backpack 1, the lighting means 51 can be disposed in correspondence with the mouth 5 of the form of the character 21.

In the example of FIG. 1, the interactive backpack 1 comprises both lighting means 41, 51 in correspondence with the eyes 4 and with the mouth 5, respectively.

The present interactive backpack 1 can further comprise an actuator 31, 61 for the control means 7. The actuator 31, 61 can comprise, for example, a switch or the like capable of activating the control means 7. The actuator 31, 61 can be disposed in an attachment which is joined to the backpack body 2. The join can be carried out, for example, by means of stitching, joining with adhesive, stapling, press fitting, welding, engagement or any other type of means suitable for such purpose.

The attachment can be manufactured in a flexible material, such as fabric, plastic, etc. or the like.

FIG. 1 shows a schematic view of a first embodiment of the present invention, wherein the actuator 61 can be disposed in an element linked to the form of the character 21, with the element being linked to an example of an attachment. In turn, the ear 6 can be an example of an element linked to the form of the character 21.

Figure 2:
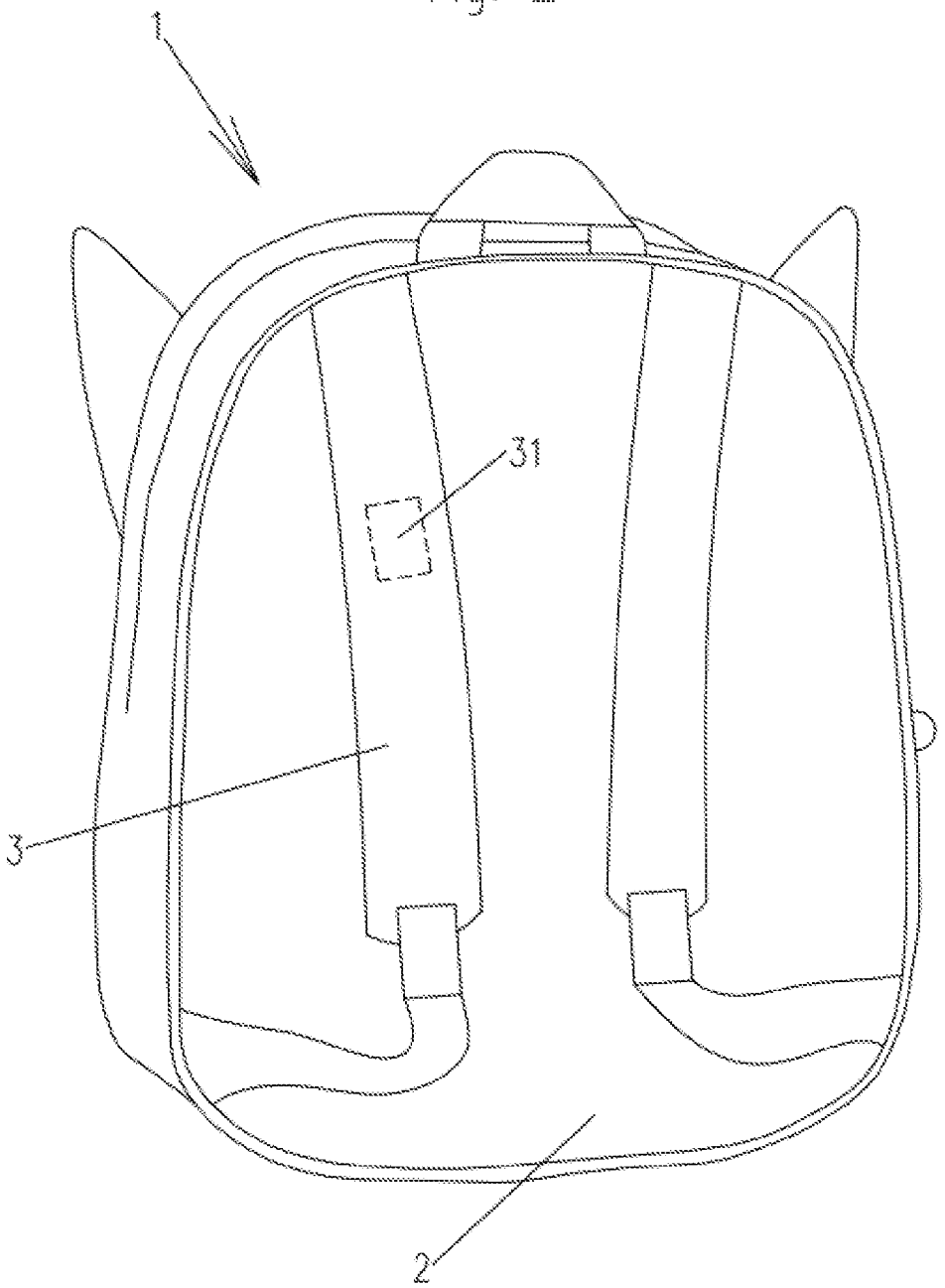
FIG. 2 is a schematic rear perspective view of a second embodiment of the present invention.

FIG. 2 shows a schematic view of a second embodiment of the present invention, wherein the actuator 61 for the control means 7 can be disposed in at least one belt 3 linked to the backpack body 2, with the belt 3 being another example of an attachment. As can be seen in FIGS. 1 and 2, the backpack body 2 can be linked to a pair of belts 3.

In order to power all the electrical elements of the present invention, the control means 7 can be linked to a power supply 9. The power supply 9 could be, for example, a battery, cell, or the like.

Figure 3:
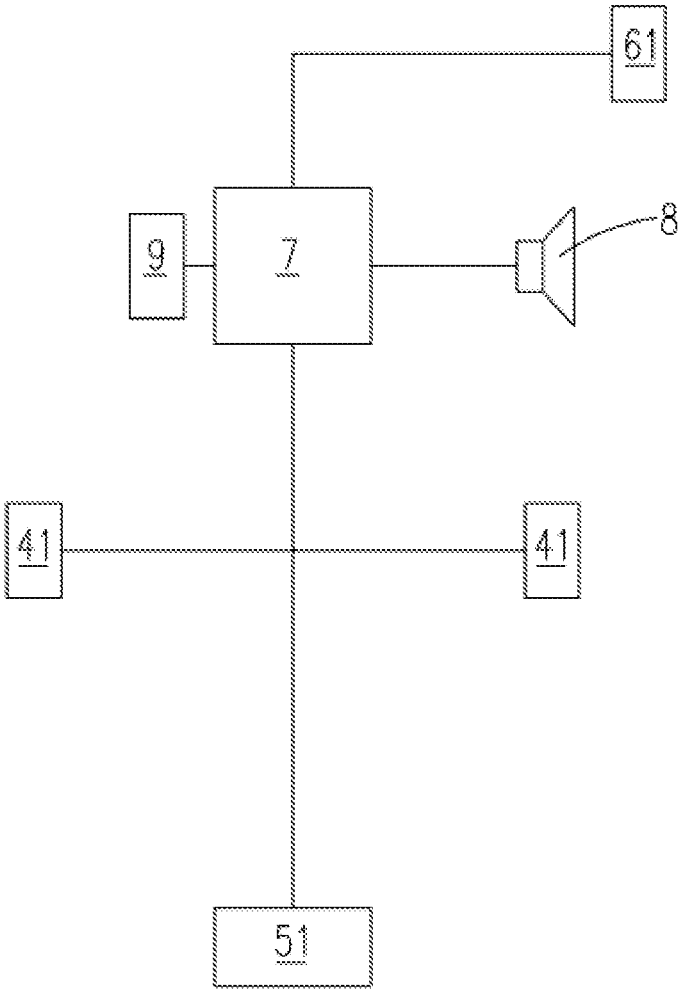
FIG. 3 is a depiction of a circuit diagram of some elements of the present invention.

FIG. 3 shows a depiction of a circuit diagram of the elements and electrical connections between such elements of the present invention, wherein the lighting means 41, 51, the sound means 8, the control means 7, the actuator 61 and the power supply 9, among others, can be seen depicted schematically. Despite having depicted only the actuator 61 in FIG. 3, actuator 31 would be located in the same position as actuator 61.

The location of the control means 7 may vary, but by way of example, they can be located in the backpack body 2 and be physically linked to the rest of the elements by means of cables, for example, or any other type of connection with or without cables. The power supply 9 could be located inside or next to the control means 7, in a readily accessible position so that the user can replace the power supply 9 should it malfunction or run out. The sound means 8 and the light means 41, 51 can likewise be disposed in the backpack body 2.

When the child user uses the interactive backpack 1, he or she may keep his or her objects inside the backpack body 2, equipped with zippers, clips or the like, for example, to access or close the inside thereof. When the user wants to put the lighting means 41, 51 and the sound means 8 into operation, he or she simply has to activate the actuator 31, 61 in an attachment which may be in a belt 3 or in an element linked to the backpack body, such as the ear 6. The control means 7 activate the lighting means 41, 51 and the sound means 8 in a synchronized and coordinated manner. Audio tracks, for example a series of numbers in different languages, music, messages or sounds that are typical of the character, can be played back. The properties or parameters of the audio that is emitted may be predetermined by the control means 7 configured for such purpose, where properties or parameters are, for example, volume, tone, etc.

The lighting means 41, 51 can start to emit light with predetermined characteristics in a simultaneous and coordinated manner. The light may vary in intensity, rhythm, frequency, or any other property such that an effect similar to that displayed by the character on the television, in the movies, on the Internet, etc., is produced. These predetermined properties or parameters of the light can be regulated by the control means 7. Actuation of the different means may vary depending on the information stored in the control means 7.

The predetermined operations of the lighting means 41, 51 and the sound means 8 can be performed in a coordinated manner with respect to one another as a result of the control means 7. In fact, activation of the lighting means 41, 51 and the sound means 8 may be the result of predefined parameters. For example, the lighting means 41 of the eyes 4 can be lit up with an intensity, frequency, etc., which are predetermined (parameters) and in a manner which is coordinated with related audio which will have a suitable tone, volume, etc. The character is thereby realistically simulated, attracting the attention of the child user who can learn while playing with the interactive backpack 1.

Depending on the interactive backpack 1, it may comprise lighting means 51 in correspondence with the mouth 5, for example a plurality of LEDs disposed along a line, for example, such that it simulates the opening of the mouth 5 when the character of the interactive backpack 1 talks.

Despite having only described several particular embodiments and examples of the invention herein, a person skilled in the art will understand that other alternative embodiments and/or uses of the invention, as well as obvious modifications and equivalent elements, are possible. Furthermore, the present invention covers all the possible combinations of the specific embodiments which have been described. The scope of the present invention must not be limited to specific embodiments, but rather it must be determined solely by a suitable reading of the attached claims.

The invention claimed is:

1. An interactive backpack having a backpack body, wherein the backpack body includes at least one form of a character, characterized in that the backpack additionally comprises:

a first lighting means disposed in correspondence with an eye of the form of the character;

a second lighting means disposed in correspondence with a mouth of the form of the character;

sound means;

control means linked to the first and second lighting means and said sound means, wherein the control means are configured for the synchronized and coordinated activation of the first and second lighting and sound means; and at least one actuator linked to the control means so that said first and second lighting and said sound means are activated in synchrony and coordination when a user directly actuates said at least one actuator, said actuator being disposed in an attachment which is joined to the backpack body.

2. The interactive backpack according to claim 1, wherein the first lighting means is configured and assembled in the backpack body such that said first lighting means illuminate from inside said eye of the form of the character.

3. The interactive backpack according to claim 1, wherein the control means is further configured for storing at least one audio track.

4. The interactive backpack according to claim 1, wherein the first and second lighting means comprise at least one light emitting diode (LED).

5. The interactive backpack according to claim 1, wherein the attachment is made of a flexible material.

6. The interactive backpack according to claim 1, wherein the attachment is an element linked to the form of the character.

7. The interactive backpack according to claim 6, wherein the attachment is an ear of the form of the character.

8. The interactive backpack according to claim 1, wherein the attachment is a belt for carrying the backpack.

9. The interactive backpack according to claim 1, wherein the sound means comprises at least one loudspeaker.

10. The interactive backpack according to claim 1, wherein the control means is configured for the synchronized and coordinated activation of the lighting and sound means with predefined operating parameters.

* * * * *